United States Patent [19]

Wiedmer

[11] Patent Number: 4,699,284

[45] Date of Patent: Oct. 13, 1987

[54] SYNTHETIC CONTAINER CLOSURE WITH GUARANTEE RING

[75] Inventor: Ernst Wiedmer, Näfels, Switzerland

[73] Assignee: Walter Wiedmer AG Plastikform, Nafels, Switzerland

[21] Appl. No.: 882,904

[22] PCT Filed: Oct. 3, 1985

[86] PCT No.: PCT/CH85/00146

§ 371 Date: Jun. 6, 1986

§ 102(e) Date: Jun. 6, 1986

[87] PCT Pub. No.: WO86/02335

PCT Pub. Date: Apr. 24, 1986

[30] Foreign Application Priority Data

Oct. 9, 1984 [CH] Switzerland ..... 4837/84

[51] Int. Cl.[4] ..... B65D 41/34

[52] U.S. Cl. ..... 215/246; 215/252

[58] Field of Search ..... 215/246, 252

[56] References Cited

U.S. PATENT DOCUMENTS 4,415,094 11/1983 Baunsfelt ..... 215/252

FOREIGN PATENT DOCUMENTS 67650 12/1982 European Pat. Off. .
3316688 11/1984 Fed. Rep. of Germany .
2457813 12/1980 France .
1384370 2/1975 United Kingdom .

*Primary Examiner*—Donald F. Norton
*Attorney, Agent, or Firm*—Ladas & Parry

[57] ABSTRACT

The closure device has a guarantee ring (4) of which the inner (5) and outer (6) walls are so formed so to be easily separated from the injection mold. The inner wall (5) forms an angle ($\alpha$) with the inner wall (8) of the cylindrical closure, respectively with its longitudinal axis (A). The outer wall (6) has a rounded profile (11) directly at the limit of the strips (3) to provide the wall with the desired thickness (d) at a determined location (12). Said rounded profile (11) facilitates the extraction of the closure (1), with the strips (3) and the guarantee ring (4), from the funnel-like upper plunger (10), after withdrawal of the lower plunger (9).

10 Claims, 4 Drawing Figures

SYNTHETIC CONTAINER CLOSURE WITH GUARANTEE RING

Figure 1:
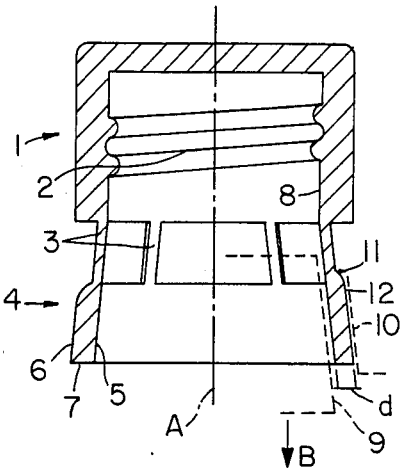

The invention relates to a synthetic closure for a container, with a guarantee ring which is connected to the closure by means of strips in order to indicate the first opening of the container.

Guarantee rings are used in increasing numbers. Their manufacture is carried out together with the closure, of a container. i.e. the guarantee ring and the strips are connected to each other and are made in one piece by means of injection moulding. To this effect, an inner and an outer mould, so-called plungers, are used. The inner or lower plunger is withdrawn after injection whereupon the completely injected and to some extent cooled but still partially plastic closure is ejected upwardly from the outer or upper plunger. The withdrawal of the lower plunger and the extraction of the upper one causes friction between the closure and the plunger walls which the closure must support in order to come out of the mould without damage.

At this point it is essential to briefly refer to the function of the strips. Their purpose is to indicate at the closure which, after having cooled completely, has been placed onto a container, the first opening of the latter, i.e. the first removal of the closure since they are torn apart at the smallest rotation of the closure because the guarantee ring does not rotate. To this effect the strips must therefore be made weaker with regard to the closure and the guarantee ring. Thus they must have a reduced width and thickness.

The problem of the friction referred to earlier herein is a further consideration. If the friction is too great, the strips will have been damaged when the closure is removed from the mould, during the so-called extraction step. This must be avoided. It is noted that a slow removal or extraction step might overcome this problem. However, such a procedure is impractical due to the necessity of obtaining a very high number of closures in a short time. The extraction step must therefore be carried out in the quickest manner possible.

According to the invention, this problem is, solved by the suitable shaping of the closure such that the inner wall of the gurarantee ring enlarges steadily in diameter from the strips toward its free end while the outer wall at least at the limit of the strips, runs in an arc up to a location on which the full wall thickness of the guarantee ring is attained.

The extraction step is thus substantially faciliated by this sort of shape and the danger of damaging the stips is avoided. The conical shape of the guarantee ring is provided by a lower plunger that is shaped as a truncated cone. If the latter now moves downwards, exactly within the rotational axis of the closure just moulded, it can easily be seen that no friction occurs save for an initial static friction at the beginning of the extraction. A gap is immediately formed between plunger and closure thanks to the conical shape so that the motion of the plunger is carried out without friction. This is contrary to the commonly cylindrical plungers and likewise guarantee rings on which, due to the constant diameter, a sliding friction occurs over the entire height.

It appears that the ejection of the closure together with its conical guarantee ring which is carried out upwards out of the upper plunger, causes some difficulties. This is due to the free end of the guarantee ring which has a greater diameter than the upper end which borders the strips. The guarantee ring must therefore be essentially forced through a funnel so that a sliding friction occurs. However, it must be remembered that the lower plunger has already moved from its initial position as already mentioned and that the closure itself is still in a plastic state and thus can be deformed. It can therefore compress itself into the free space that was previously taken up by the lower plunger but resumes its initial shape after having passed through. This passage of the guarantee ring through the upper plunger is also facilitated by the shape of the outer wall of the guarantee ring; the arc-like shaping of said wall enables a gradual compression into the space already referred to so that the load on the strips which must draw the guarantee ring with them, remains within limits.

Figure 2:
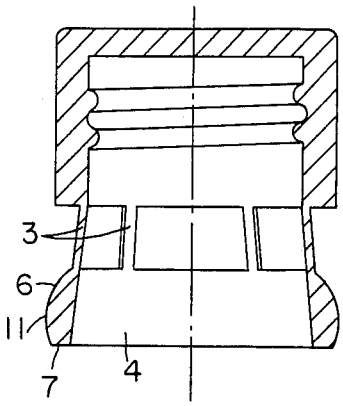
Figure 3:
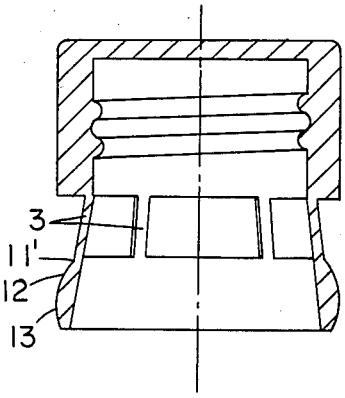

The invention will be explained in more detail by referring to the annexed drawings wherein FIG. 1 illustrates a first preferred embodiment of the closure and the guarantee ring, FIGS. 2 and 3 illustrate additional possible embodiments, and FIG. 4 discloses a part view from FIG. 1 in a larger scale.

FIG. 1 discloses a closure 1 in section. It is equipped with an interior thread 2 in order to screw the closure onto a bottle or a container (not represented) provided with a corresponding exterior thread. At the lower free end, along its periphery, strips 3 are distributed onto which a guarantee ring is attached. The latter is generally designated as 4, its inner wall with 5 and its outer wall with 6. In the following reference is made to the differences in the shaping of the guarantee ring, in particular with regard to the contours.

Generally the inner wall 5 is shaped such that its diameter continuously increases from the strips 3 towards the free end 7 of the guarantee ring. The interior wall thus forms in section a straight line as can be taken from the drawings, said line running at an angle $\alpha$ to the inner wall 8 of the closure; since the latter is cylindrical and thus parallel to the axis A of the closure, it can be said that the inner wall runs at this angle to said axis. Preferably this angle is 1.5 to 2.5 degrees.

The reason for this arrangement has already been mentioned. In FIG. 1 a part of the inner mould half, thus of the lower plunger 9, is represented in dashed lines. This plunger is generally of a truncated cone shape whereas the upper plunger 10 (also represented only partially and in dashed lines) has a complementary shape. In the intermediate space the guarantee ring 4 and the strips 3 are formed. After termination of the injection the lower plunger 9 displaces itself in the direction of arrow B downwards, coaxially to axis A. It is represented in such an intermediate position in order to show that already after initiating said downward movement a space "s" is created between it and the completely moulded guarantee ring 4 and the strips 3. Thus plunger 9 immediately separates from said parts and there is practically no sliding friction. The thin strips 3 therefore are not stressed.

A stress occurs afterwards but is substantially alleviated by the movement of lower plunger 9. The closure must namely now be ejected upwards from upper plunger 10. As can be taken from FIG. 1, guarantee ring 4 and strips 3 must be forced through the lower, conically shaped part of plunger 10 which becomes narrower towards its upper end. This, however, is possible because the material of the closure is still warm and therefore still particularly resilient and can easily be compressed for a short time; it will afterwards resume at once its original shape. Nevertheless this compression, in particular the one of the material of guarantee ring 4, represents a stress for strips 3 which practically must draw the guarantee ring behind them (the ejection of the closure is effected by placing an ejection device onto closure 1). In order to now reduce this stress, outer wall 6 is made arc-like after its junction with strips 3. In FIG. 1 this are extends at least to a location 12 on which the full wall thickness d of guarantee ring 4 is reached. From there outer wall 6 runs, on this embodiment, parallel to inner wall 5; the wall thickness now remains constant. This embodiment is the simplest one because it also facilitates the checking of the dimensions during manufacture of plungers 9, 10. Arc 11 provides, during the movement already mentioned, a gradual compression of guarantee ring 4 and thus avoids an abrupt increase of the tractive forces acting upon strips 3.

FIGS. 2 and 3 show other embodiments. In FIG. 2 arc 11 of outer wall 5 continues to the free end 7 where the wall thickness of the guarantee ring decreases again. In FIG. 3 arc 11' is concave when seen from the outside instead of convex as on FIGS. 1 and 2; on location 12 transition is made to an arc 13 which is equal to arc 11 in FIG. 2. The essential fact is that the transitions on both ends of arc 11' have no discontinuities and thus are smooth.

The arcs in the embodiments represented may be of any geometrical shape (parabolic, sine-shaped, hyperbolic). However, in view of manufacture, circular arcs, i.e. of constant radius, are the simplest ones whereby several arcs may be joined, each one having its own radius, as the case may be. FIG. 4 discloses the simplest embodiment, in analogy to FIG. 1; arc 11 here is of a radius "r".

Figure 4:
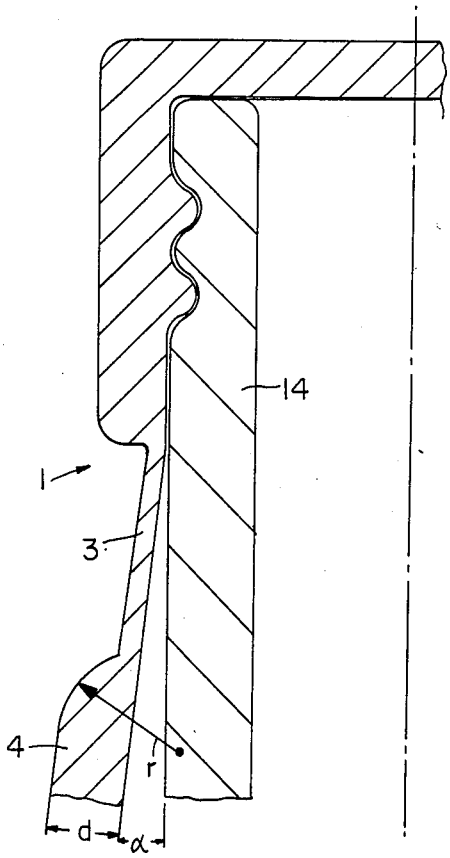

From FIG. 4 one may further appreciate that not only guarantee ring 4 but also strips 3 are at a distance from the container, here a bottle 14, even after closure 1 has been attached. Due to the spacing and in particular, the conical enlargement guarantee ring 4 is prevented from resting against bottle 14 or making contact with it thereby preventing the compression and damage of strips 3.

The invention is of particular advantage if the illustrated closures are made of heat-shrinkable material. Then they are suitable for being used in so-called heat-shrinking plants. In such plants the containers with the closures in place are passed through a heating device whereby heat acts on the latter closures. As soon as this heating action ends or if cold acts on the containers, the yet loose guarantee ring shrinks and lays firmly against the container neck. Only thanks to this effect respectively thanks to the use of such material it is possible to form the guarantee ring during manufacture of the closure in such a way that it enlarges itself towards its lower end and thus to greatly facilitate or even enabling only a trouble free placing of the closure onto the container.

I claim:

1. A synthetic closure for a container, said closure comprising:

a cap having a first wall thickness for sealing the opening of said container;

safety means having a first end and a second end opposite said first end, said first end being connected to said cap, said safety means having an inner and an outer surface between said first and second ends and defining a second frangible wall between said inner and outer surfaces, said frangible wall being of a lesser thickness than said first wall, said inner surface increasing smoothly in diameter from said first end to said second end; and a guarantee ring attached to said second end of said safety means, said guarantee ring having an inner surface and an outer surface defining a wall thickness generally greater than that of said frangible wall thickness, said inner surface of said guarantee ring being integral of said inner surface of said safety means and increasing in diameter from said second end such that said inner surfaces of said guarantee ring and said safety means in combination define a truncated cone having the narrowest portion adjacent said cap, said outer surface of said guarantee ring arcing toward said outer surface of said safety means to from a smooth nonabrupt connection therewith.

2. The closure according to claim 1 wherein said outer surface of said guarantee ring is generally parallel to said inner surface of said guarantee ring so that said wall thickness of said guarantee ring is generally constant.

3. The closure according to claim 1 wherein said outer suface of said guarantee ring is convex in shape.

4. The closure according to claim 1, wherein said closure has a rotational axis and wherein said inner walls of said guarantee ring and said sealing means when seen in section, forms an angle of 1.5 to 2.5 to said rotational axis of the closure.

5. The closure according to claim 1 wherein said closure consists of heat-shrinkable material.

6. The closure according to claim 1, wherein said outer surface of said guarantee ring concavely arcs toward said outer surface of said sealing means to form a smooth connection therewith.

7. The closure according to claim 6, wherein said outer surface of said guarantee ring is generally convex in shape and smoothly and non-abruptly changes to said concave shape for joinder with said outer surface of said sealing means.

8. The closure according to claim 6, wherein said sealing means is a plurality of strips extending nonparallel of said container.

9. The closure of claim 6, wherein said closure is formed by means of an outer mold and an inner mold, said inner mold is a plunger having a truncated cone shape for the formation of said inner surface of said safety means and said guarantee ring.

10. The closure according to claim 1, wherein said outer surface of said safety means is generally parallel of said inner surface of said safety means.

* * * * *